US009481494B2

(12) United States Patent
Ozaki et al.

(10) Patent No.: US 9,481,494 B2
(45) Date of Patent: Nov. 1, 2016

(54) SLIDER STRUCTURE

(71) Applicant: MUPACK OZAKI CORPORATION, Yao (JP)

(72) Inventors: Ikuko Ozaki, Yao (JP); Takeo Takashiro, Yao (JP)

(73) Assignee: MUPACK OZAKI CO., LTD., Yao-shi (JP)

( * ) Notice: Subject to any disclaimer, the term of this patent is extended or adjusted under 35 U.S.C. 154(b) by 0 days.

(21) Appl. No.: 14/786,747

(22) PCT Filed: Oct. 20, 2014

(86) PCT No.: PCT/JP2014/077828

§ 371 (c)(1),
(2) Date: Oct. 23, 2015

(87) PCT Pub. No.: WO2015/060243

PCT Pub. Date: Apr. 30, 2015

(65) Prior Publication Data

US 2016/0083148 A1 Mar. 24, 2016

(30) Foreign Application Priority Data

Oct. 22, 2013 (JP) ..... 2013-218926

(51) Int. Cl.
*B65D 33/25* (2006.01)
*A44B 19/16* (2006.01)

(52) U.S. Cl.
CPC ..... *B65D 33/2575* (2013.01); *A44B 19/16* (2013.01); *B65D 33/2591* (2013.01)

(58) Field of Classification Search
CPC ..... A44B 19/16; B65D 33/2575; B65D 33/2591
See application file for complete search history.

(56) References Cited

U.S. PATENT DOCUMENTS 5,020,194 A * 6/1991 Herrington ..... B65D 33/2591 24/389
5,871,281 A * 2/1999 Stolmeier ..... B65D 33/2591 24/417
5,896,627 A * 4/1999 Cappel ..... B65D 33/2591 24/400
6,721,999 B2 * 4/2004 Meager ..... A44B 19/16 24/399
6,874,205 B1 * 4/2005 Savicki ..... A44B 19/267 24/30.5 R
6,939,041 B2 * 9/2005 Kinigakis ..... B65D 33/2591 383/203
7,017,240 B2 * 3/2006 Savicki ..... B65D 33/2591 24/387
7,263,748 B2 * 9/2007 Blythe ..... A44B 19/267 24/399
7,451,530 B2 * 11/2008 Meager ..... A44B 19/16 24/399
7,797,802 B2 * 9/2010 Ackerman ..... B65D 33/2591 24/416
2003/0185468 A1 * 10/2003 Keith ..... B65D 33/007 383/9
2003/0235351 A1 * 12/2003 Plourde ..... B65D 33/2591 383/61.2
2004/0091185 A1 * 5/2004 Shibata ..... B65D 33/2591 383/210
2004/0165794 A1 * 8/2004 Plourde ..... B65D 33/2591 383/64
2006/0291754 A1 * 12/2006 Linton ..... B65D 33/2591 383/64
2008/0037909 A1 * 2/2008 Leighton ..... B31B 1/90 383/61.3
2008/0110001 A1 * 5/2008 Ausnit ..... B65D 33/2591 24/400
2010/0296756 A1 * 11/2010 Bois ..... B65D 33/2591 383/64
2013/0148916 A1 * 6/2013 Bois ..... B65D 33/2591 383/64

* cited by examiner

*Primary Examiner* — Robert J Sandy
*Assistant Examiner* — David Upchurch
(74) *Attorney, Agent, or Firm* — Kratz, Quintos & Hanson, LLP

(57) ABSTRACT

A slider structure, provided with a first member 1 and a second member 2, in which a first insertion groove 31 inclined forward and upward, and a second insertion groove 32 inclined forward and downward, are formed by the first member 1 and the second member 2, and, an opening width dimension S1 of the first insertion groove 31 and an opening width dimension S2 of the second insertion groove 32 are reduced when the first member 1 and the second member 2 are relatively moved and mutually come close to conduct stopping in left-and-right direction W of a fastener male-female portion Fa in the first insertion groove 31 and another male-female portion Fb in the second insertion groove 32.

5 Claims, 13 Drawing Sheets

SLIDER STRUCTURE

FIELD OF THE INVENTION

This invention relates to a slider structure for opening and closing fasteners.

BACKGROUND ART

Conventionally, a slider structure for opening and closing operation of a fastener of a bag body for storing is attached as to cross an opening portion (fastener) (refer to patent document 1, for example).

PRIOR ART DOCUMENT

Patent Document

Patent Document 1: Japanese Provisional Publication NO. 2003-20050.

OUTLINE OF THE INVENTION

Problems to be Solved by the Invention

The conventional slider structure has a problem that the opening portion must be disposed on an edge portion because the slider structure is attached to cross the opening portion. That is to say, as shown in FIG. 17 and FIG. 18, the construction can't be applied to a fastener F disposed on an opening portion 9*d* opening in up-and-down direction as to divide an obverse wall portion 90 into a first sheet portion 91 and a second sheet portion 92 (an opening portion 9*d* to open a middle portion of a sheet on an upper side in up-and-down direction) between an end edge portion 9*a* and another end edge portion 9*b* of a bag body 9 placed on a horizontal placement face.

Therefore, it is an object of the present invention to provide a slider structure, with which a fastener, disposed on an opening portion opening a sheet middle body on an upper side of a bag body in up-and-down direction, can be opened and closed, and the slider structure is easily attached to the bag body.

Means for Solving the Problems

To achieve the above objects, a slider structure of the present invention is provided with a first member having a gathering portion, to press a fastener male-female portion disposed on a first sheet portion and another fastener male-female portion disposed on a second sheet portion mutually in up-and-down direction to be hitched, on a rear end portion, and a second member attached to the first member as to move for a predetermined back-and-forth dimension in back-and-forth direction; a first insertion groove inclined forward and upward to which the fastener male-female portion is inserted and opening to a side, and a second insertion groove inclined forward and downward to which the other fastener male-female portion is inserted and opening to another side, are formed by the first member and the second member; and an opening width dimension of the first insertion groove and an opening width dimension of the second insertion groove are reduced when the first member and the second member are relatively moved in the back-and-forth direction and mutually come close to conduct stopping in left-and-right direction of the fastener male-female portion in the first insertion groove and the other fastener male-female portion in the second insertion groove.

And, a connecting means, to connect the first member and the second member on an approach completed position on which the first member and the second member are relatively moved in the back-and-forth direction and made mutually proximate, is provided.

And, the second member prevents the gathering portion of the first member from being enlarged and deformed in the up-and-down direction on the approach completed position on which the first member and the second member are relatively moved in the back-and-forth direction and made mutually proximate.

And, a slide locking means, to partially and forcedly reduce the opening width dimension of the first insertion groove to press the first sheet portion for stopping movement in the back-and-forth direction on the approach completed position on which the first member and the second member are relatively moved in the back-and-forth direction and made mutually proximate.

Effects of the Invention

According to the present invention, the slider structure can be applied to a fastener disposed on an opening to open a sheet middle portion on an upper side of a bag body. The opening portion of the bag body can be easily and smoothly opened and closed. Attachment to the opening portion of the bag body can be easily and swiftly conducted. The slider structure can be attached to the bag body for storing to which the opening portion and the fastener are provided.

EMBODIMENTS OF THE INVENTION

Preferred embodiments of the present invention will now be described with reference to the accompanying drawings.

Figure 1:
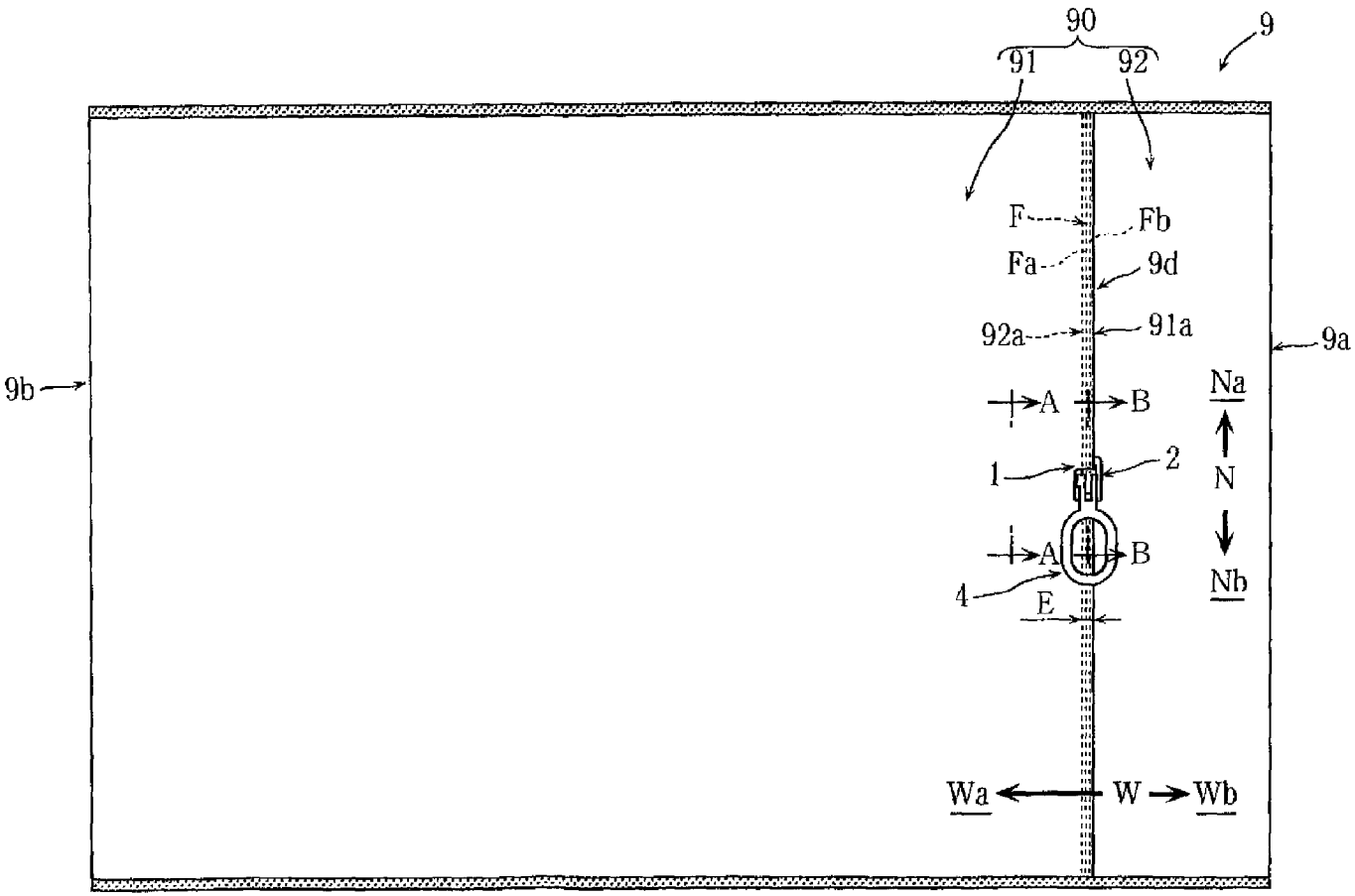
FIG. 1 A top view showing attached state to a bag body of an embodiment of the present invention.
Figure 17:
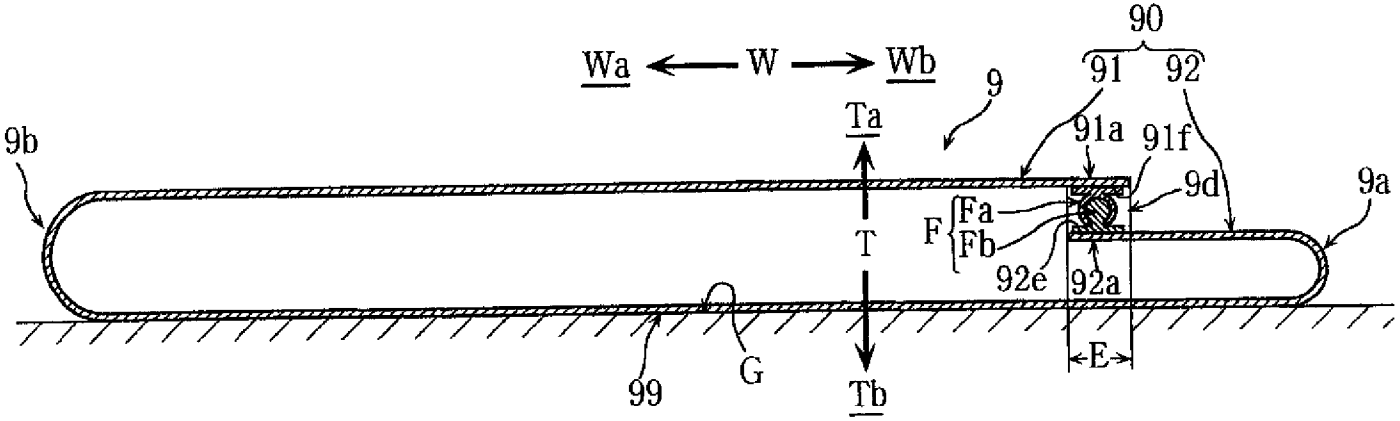
FIG. 17 A cross-sectional front view showing an example of the bag body of closed state of the fastener.
Figure 18:
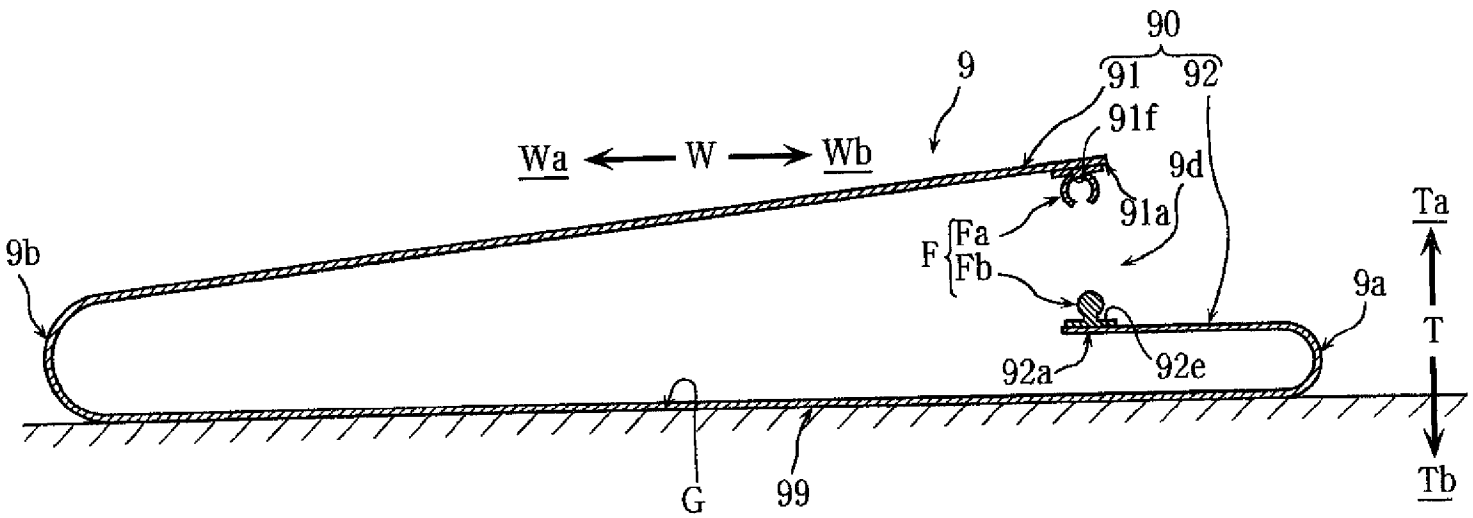
FIG. 18 A cross-sectional front view showing the example of the bag body of opened state of the fastener.

A slider structure relating to the present invention is, for example, as shown in FIG. 1, FIG. 17, and FIG. 18, for opening and closing operation of a fastener F disposed on an opening portion 9*d* opening in up-and-down direction T as to divide an obverse wall portion 90 into a first sheet portion 91 and a second sheet portion (an opening portion 9*d* to open a middle portion of a sheet on an upper side in up-and-down direction) between an end edge portion 9*a* and another end edge portion 9*b* of a bag body 9 in standard posture in which a reverse wall portion 99 of the bag body 9 is placed along a horizontal placement face G (parallel to the placement face G).

In the bag body 9, an opening end edge portion 92*a* of the second sheet portion 92 and an opening end edge portion 91*a* of the first sheet portion 91 are disposed as to layer (lapped) in the up-and-down direction T with a predetermined lapping dimension E in a fastener width direction (left-and-right direction) W in a fastener closed state in FIG. 17. The opening end edge portion 92*a* of the second sheet portion 92 is disposed on a lower position of the opening end edge portion 91*a* of the first sheet portion 91.

A male-female portion Fa is disposed on the opening end edge portion 91*a* of the first sheet portion 91 to form the fastener F on an inner face (lower face) 91*f*, and another male-female portion Fb is disposed on the opening end edge portion 92*a* of the second sheet portion 92 to form the fastener F on an outer face (upper face) 92*e*.

To make the explanation of the present invention easy, a state, in which the bag body 9 is placed along the horizontal placement face G, is made the standard posture, a longitudinal direction of the fastener is called back-and-forth direction N, the fastener width dimension is called the left-and-right direction W, and a vertical direction (fastener height direction) is called the up-and-down direction T to explain the directions.

Figure 2:
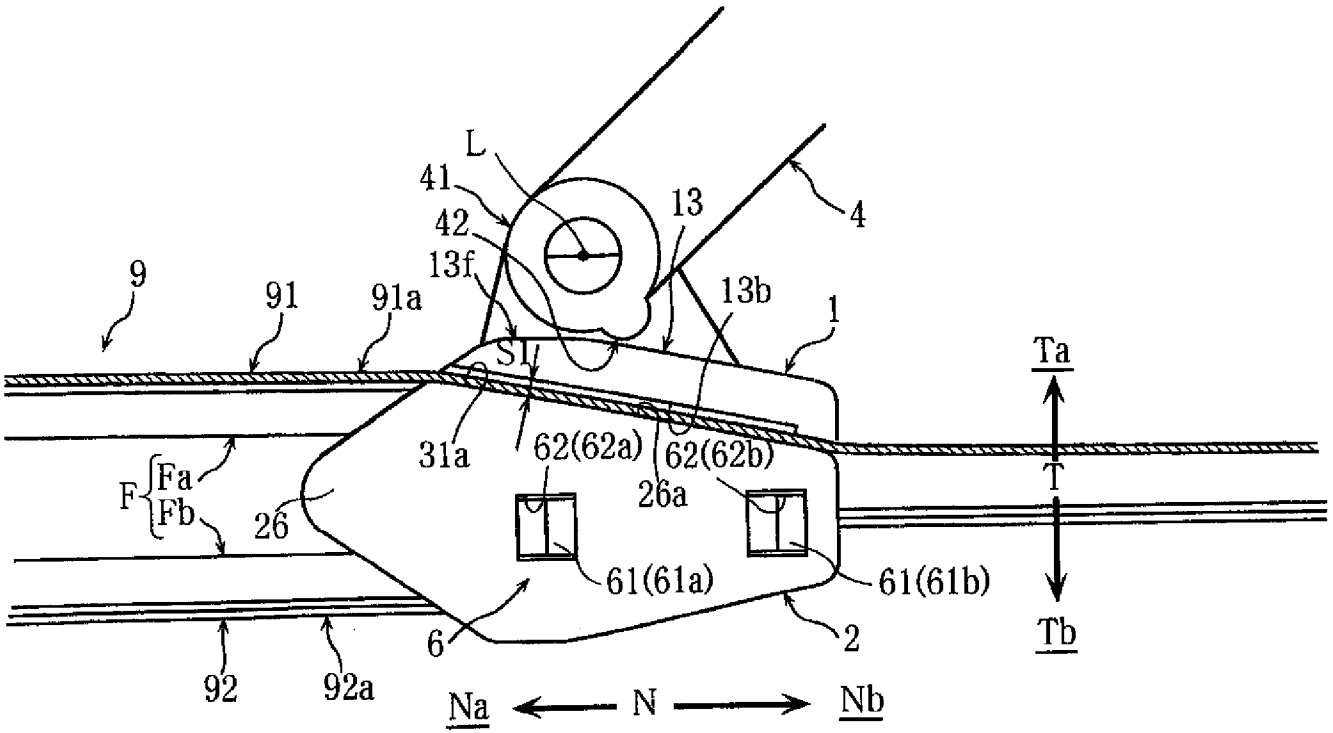
FIG. 2 A cross-sectional view along A-A line of FIG. 1.
Figure 3:
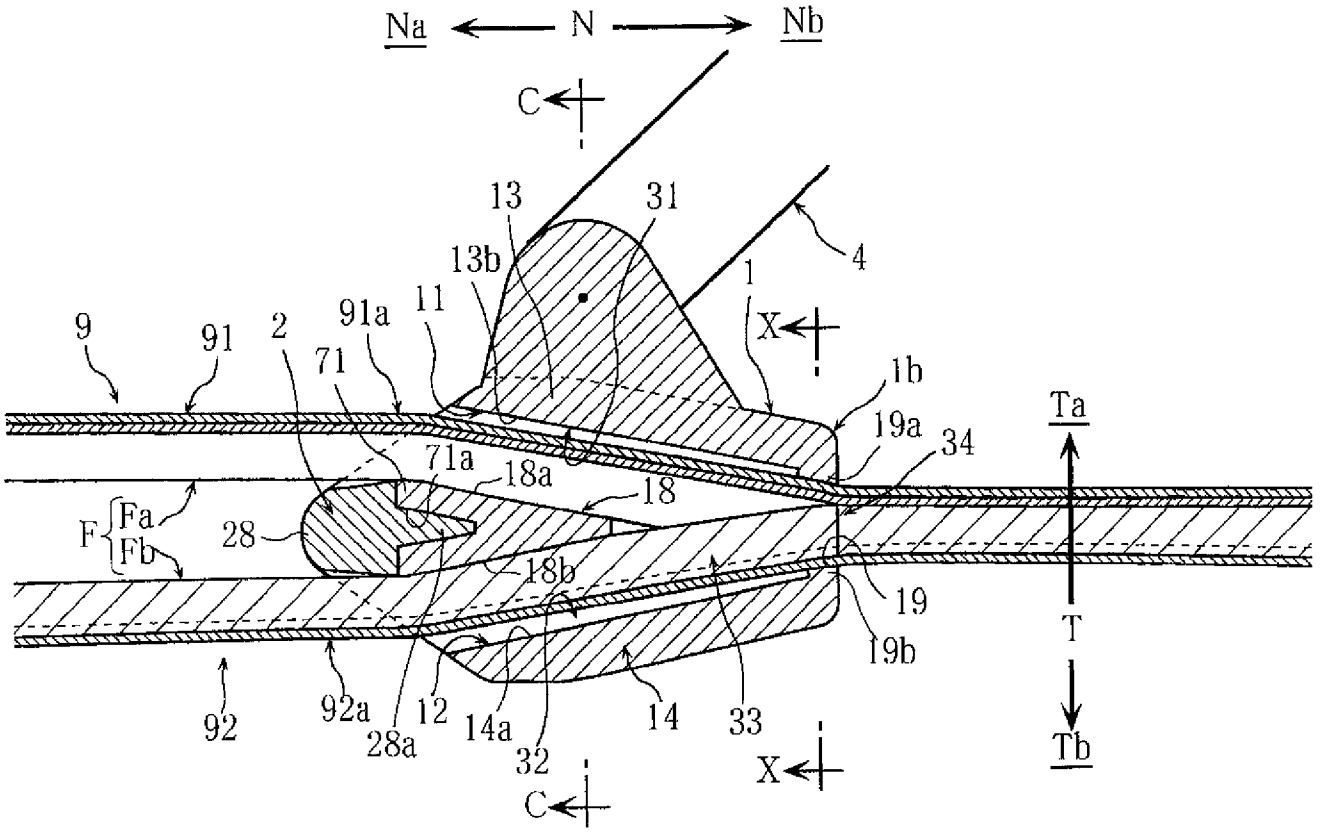
FIG. 3 A cross-sectional view along B-B line of FIG. 1.

And, the slider structure relating to the present invention is, as shown in FIG. 1 through FIG. 3, attached to the opening end edge portion 92*a* of the second sheet portion 92 and the opening end edge portion 91*a* of the first sheet portion 91 as to freely slide in the back-and-forth direction N to make the fastener F on a rear side Nb closed by sliding to a front side Na and the fastener F on the front side Na opened by sliding to the rear side Nb.

Figure 4:
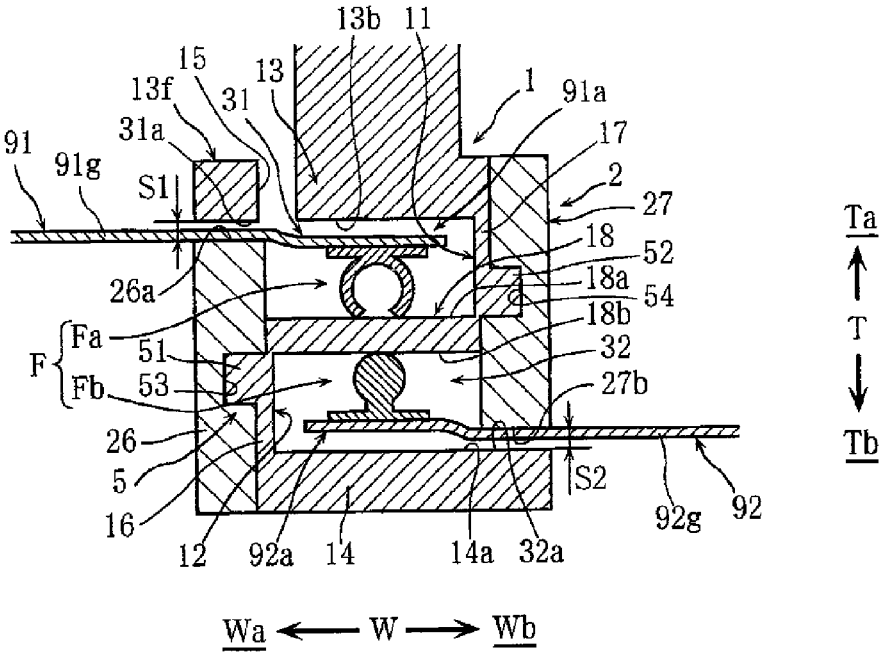
FIG. 4 A schematic cross-sectional view along C-C line of FIG. 3.
Figure 5:
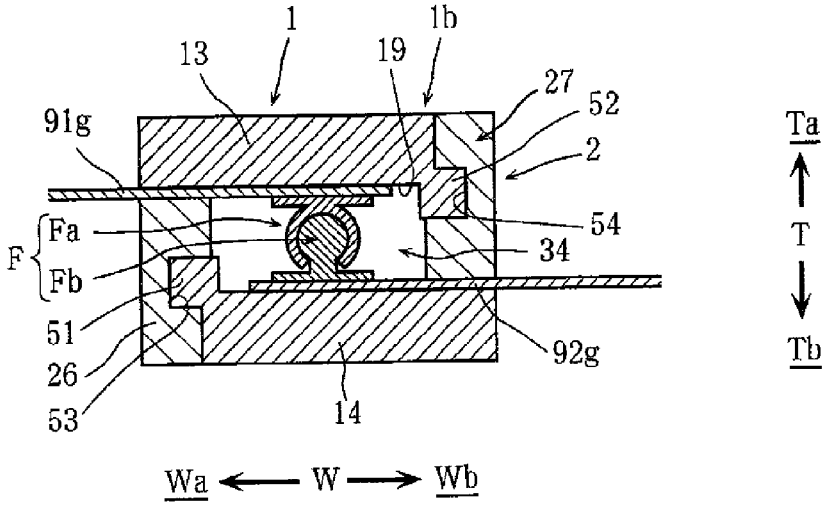
FIG. 5 A schematic cross-sectional view along X-X line of FIG. 3.

As shown in FIG. 3 through FIG. 5, a first member 1 of resin, having a departure guiding portion 18 inside to divide the fastener F in closed state into the male-female portion Fa and the other male-female portion Fb in the up-and-down direction T and a gathering portion 19 on a rear end portion 1*b* to make the male-female portion Fa and the other male-female portion Fb hitched by pressing in the up-and-down direction T, is provided.

Figure 6:
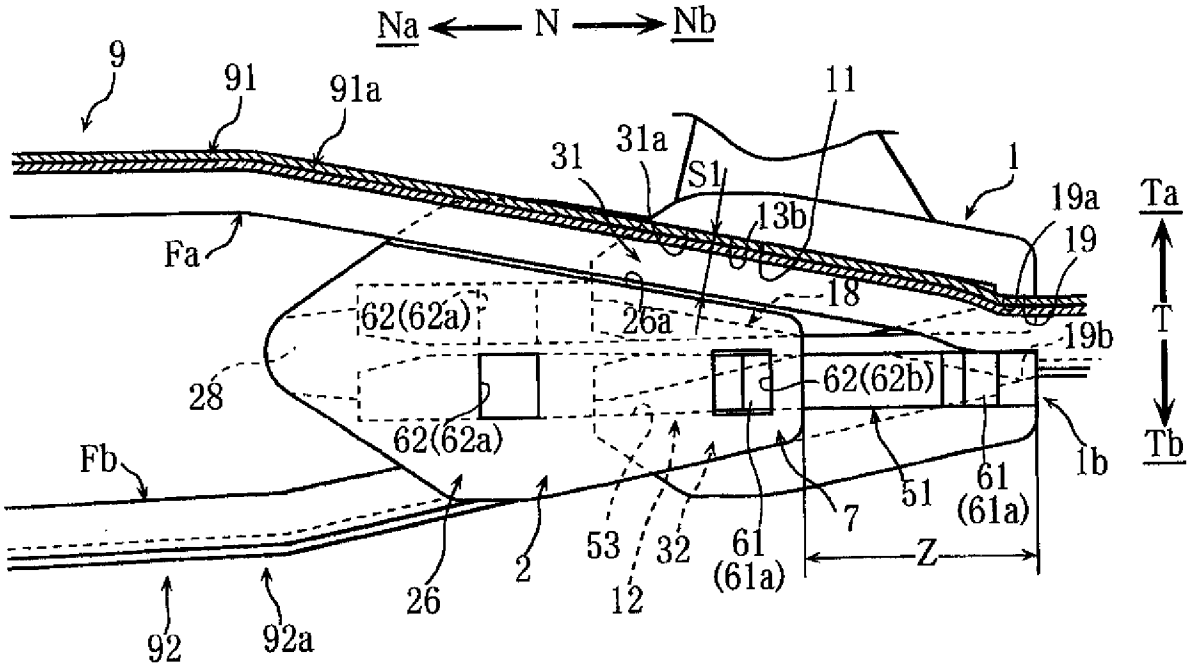
FIG. 6 A side view of one side when being attached to the bag body.
Figure 7:
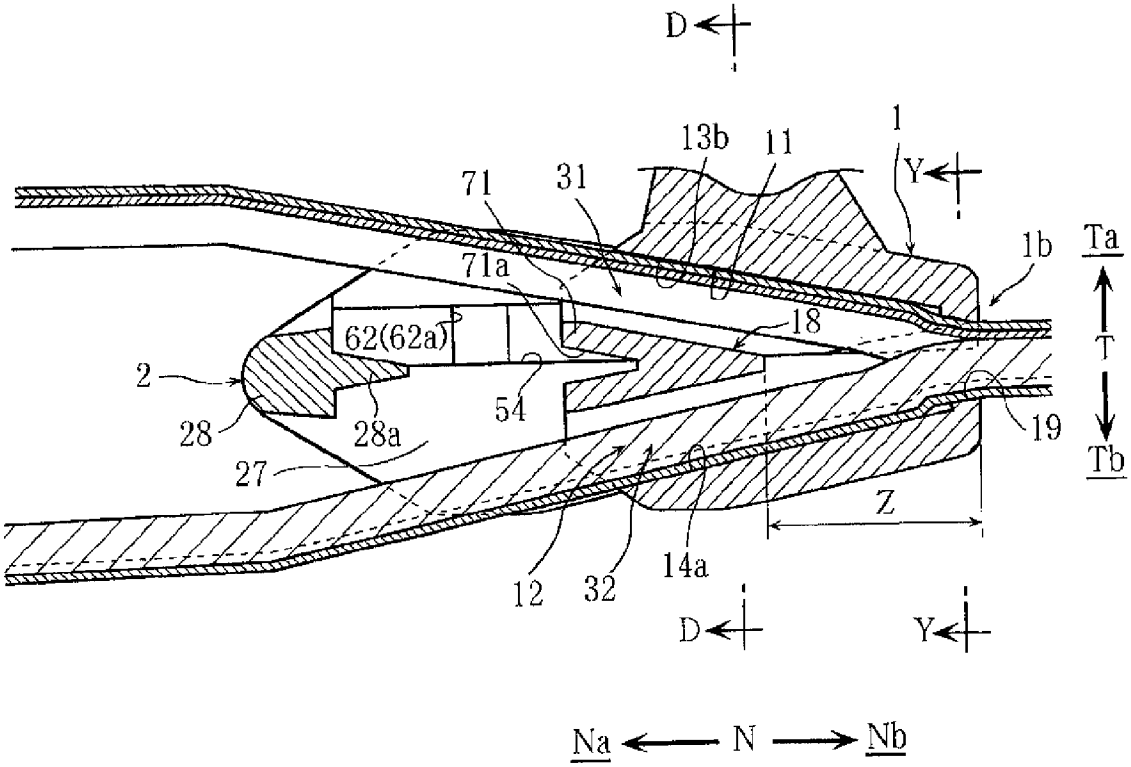
FIG. 7 A cross-sectional side view of FIG. 6.
Figure 8:
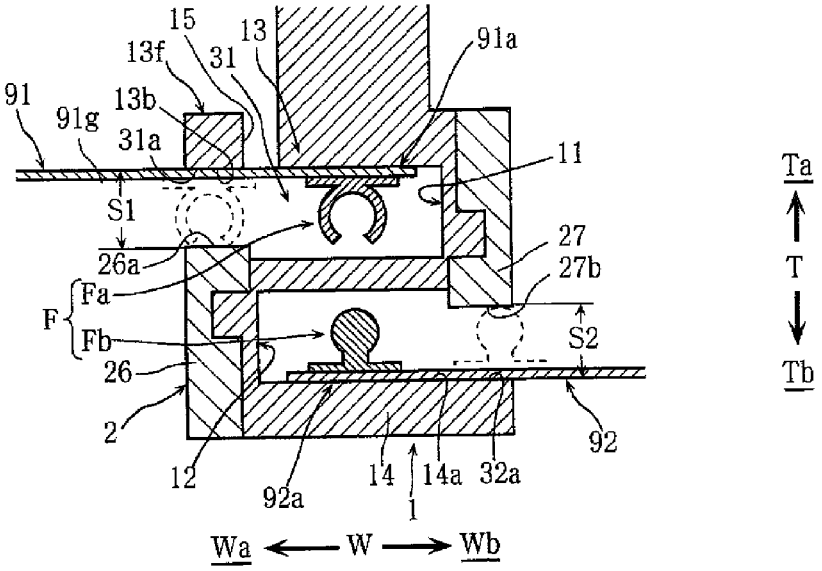
FIG. 8 A schematic cross-sectional view along D-D line of FIG. 7.

Further, as shown in FIG. 6 and FIG. 7, a second member 2 of resin, mounted to the first member 1 as to slide for a predetermined back-and-forth dimension Z in the back-and-forth direction N, is provided.

As shown in FIG. 2 through FIG. 5, the first member 1 and the second member 2 form a first insertion groove 31, inclined forward and upward and opening to one side Wa, to which the male-female portion Fa is inserted in the back-and-forth direction N, a second insertion groove 32, inclined forward and downward and opening to another side Wb, to which the other male-female portion Fb is inserted in the back-and-forth direction N, and a confluence way 33 continued to a rear portion of the first insertion groove 31 and a rear portion of the second insertion groove 32 and opening to the left-and-right direction W in an attachment completed state for open-close operation of the fastener F. Further, a Y-shaped guiding way, forming a rear gathering way 34 opening to the left-and-right direction W and continued to a rear portion of the confluence way 33, through which the closed fastener F moves, is provided to make the male-female portion Fa and the other male-female portion Fb come close and depart from in the up-and-down direction T.

The first member 1 has an upper groove portion 11 inclined forward and upward in side view of which cross section is inclined U-shape, formed with a lower face 13*b* of the upper wall portion 13 inclined forward and upward, an upper face 18*a* of the departure guiding portion 18 inclined forward and upward, and an inner face of the other side wall portion 17.

And, the first member 1 has a lower groove portion inclined forward and downward in side view of which cross section is inclined U-shape, formed with an upper face 14*a* of the lower wall portion 14 inclined forward and downward, a lower face 18*b* of the departure guiding portion 18 inclined forward and downward, and an inner face of the side wall portion 16.

And, the first member 1 has a confluence space continued to rear portions of the upper groove portion 11 and the lower groove portion 12, and the gathering portion 19.

As shown in FIG. 2, FIG. 4, and FIGS. 12 through 14, the second member 2 is provided with a first side wall portion 26, attached to the side wall portion 16 of the first member 1 as to freely slide back and forth, and having an upper face 26*a* inclined forward and upward and disposed to face a side edge portion of the lower face 13*b* of the upper wall portion 13 of the first member 1, and a second side wall portion 27, attached to the other side wall portion 17 of the first member 1 as to freely slide back and forth, and having a lower face 27*b* inclined forward and downward and disposed to face another side edge portion of the upper face 14*a* of the lower wall portion 14 of the first member 1. And, the second member 2, having a connecting portion 28 to connect the first side wall portion 26 and the second side wall portion 27 in left-and-right direction on the front side Na, is formed inclined U-shaped in top view.

And, the first insertion groove 31 is formed with the upper groove portion 11 of the first member 1 and the first side wall portion 26 of the second member 2. An opening portion 31*a* of a slit inclined forward and upward of the first insertion groove 31 is formed with the side edge portion of the lower face 13*b* of the upper wall portion 13 of the first member 1 and the upper face 26*a* of the first side wall portion 26 of the second member 2. A dimension between the lower face 13*b* of the upper wall portion 13 and the upper face 26*a* of the first side wall portion 26 is called an opening width dimension S1.

And, the second insertion groove 32 is formed with the lower groove portion 12 of the first member 1 and the second side wall portion 27 of the second member 2. Another opening portion 32*a* of a slit inclined forward and downward of the second insertion groove 32 is formed with the other side edge portion of the upper face 14*a* of the lower wall portion 14 of the first member 1 and the lower face 27*b* of the second side wall portion 27 of the second member 2. A dimension between the upper face 14*a* of the lower wall portion 14 and the lower face 27*b* of the second side wall portion 27 is called an opening width dimension S2.

And, the confluence way 33 is formed with a confluence space in the first member 1 and the first and second side wall portions 26 and 27 of the second member 2.

And, the rear gathering way 34 is formed with the gathering portion 19 of the first member 1 and the first and second side wall portions 26 and 27 of the second member 2.

And, a first slit opening, to which a film portion 91*g* of the first sheet portion 91 is inserted from the side Wa and through which the film portion 91*g* passes in the back-and-forth direction N, is formed with the side edge portion of the lower face 13*b* of the upper wall portion 13 of the first member 1 and the upper face 26*a* of the first side wall portion 26.

And, a second slit opening, to which a film portion 92*g* of the second sheet portion 92 is inserted from the other side Wb and through which the film portion 92*g* passes in the back-and-forth direction N, is formed with the other side edge portion of the upper face 14*a* of the lower wall portion 14 of the second member 2 and the lower face 27*b* of the second side wall portion 27.

Next, as shown in FIGS. 6 through 9, in a half assembled state in which the second member 2 is disposed on the front side Na for the predetermined back-and-forth dimension Z and mutually departed from the first member 1 in the back-and-forth direction N, the first insertion groove 31 is formed with the upper groove portion 11 of the first member 1 and a rear portion of the first side wall portion 26 of the second member 2. And, the second insertion groove 32 is formed with the lower groove portion 12 of the first member 1 and a rear portion of the second side wall portion 27 of the second member 2.

And, in the half assembled state, the side edge portion of the lower face 13*b* of the upper wall portion 13 of the first member 1 faces a rear side portion of the upper face 26*a* of the first side wall portion 26 of the second member 2 to form the opening portion 31*a* of the first insertion groove 31.

And, in the half assembled state, the other side edge portion of the upper face 14*a* of the lower wall portion 14 of the first member 1 faces a rear side portion of the lower face 27*b* of the second side wall portion 27 of the second member 2 to form the other opening portion 32*a* of the second insertion groove 32.

The opening width dimension S1 of the opening portion 31*a* of the first insertion groove 31 (called the first opening width dimension S1 in some cases) is set to insert the fastener male-female portion Fa of the opening end edge portion 91*a* of the first sheet portion 91 into the first insertion groove 31 from the side Wa in the half assembled state.

The opening width dimension S2 of the other opening portion 32*a* of the second insertion groove 32 (called the second opening width dimension S2 in some cases) is set to insert the fastener male-female portion Fb of the opening end edge portion 92*a* of the second sheet portion 92 into the second insertion groove 32 from the other side Wb in the half assembled state.

Then, when the first member 1 and the second member in the half assembled state are relatively moved in the back-and-forth direction N to mutually come close, the first opening width dimension S1 is reduced as the side edge portion of the lower face 13*b* of the upper wall portion 13 and the forth side portion of the upper face 26*a* of the first side wall portion 26 come close, and the second opening width dimension S2 is reduced as the other side edge portion of the upper face 14*a* of the lower wall portion 14 and the forward portion of the lower face 27*b* of the second side wall portion 27 come close.

Figure 14:
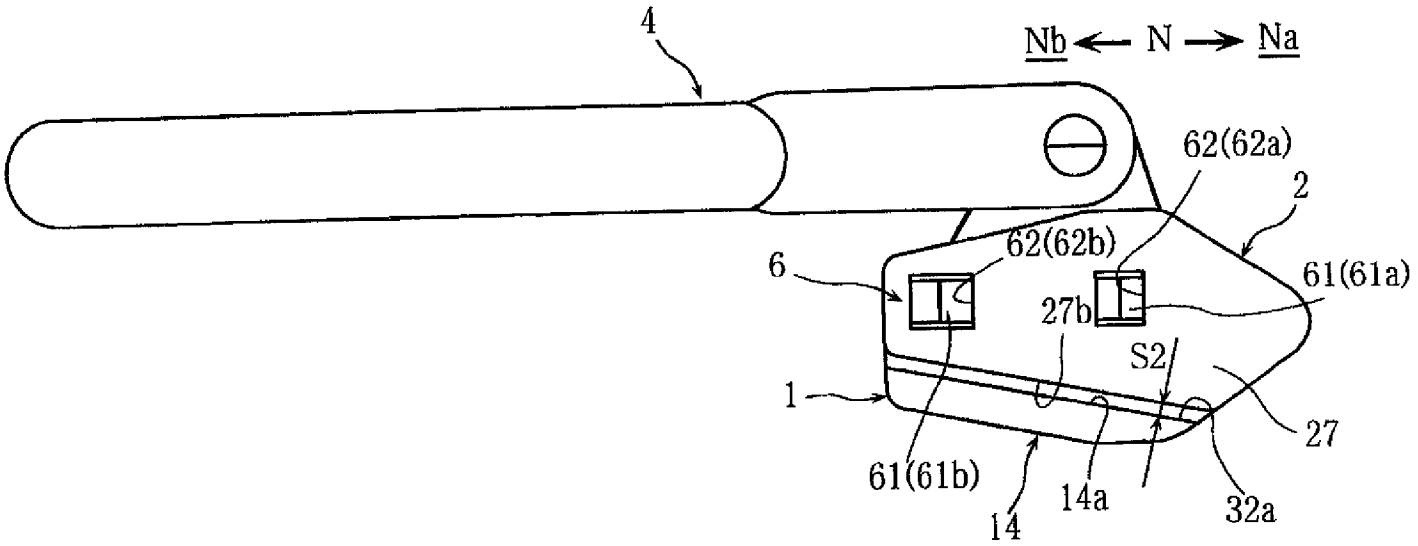
FIG. 14 A side view of another side.

As shown in FIG. 2, FIG. 4, and FIG. 14, on an approach completed position (a position on which the first member 1 and the second member 2 are approximately corresponding in side view) on which the first member 1 and the second member 2 are made mutually most proximate, the first opening width dimension S1 is set to be a dimension through which the fastener male-female portion Fa can't pass toward the side Wa, and the second opening width dimension S2 is set to be a dimension through which the other male-female portion Fb can't pass toward the other side Wb.

Therefore, stopping of the fastener male-female portions Fa and Fb in the left-and-right direction W within the insertion grooves 31 and 32 is made possible.

Figure 9:
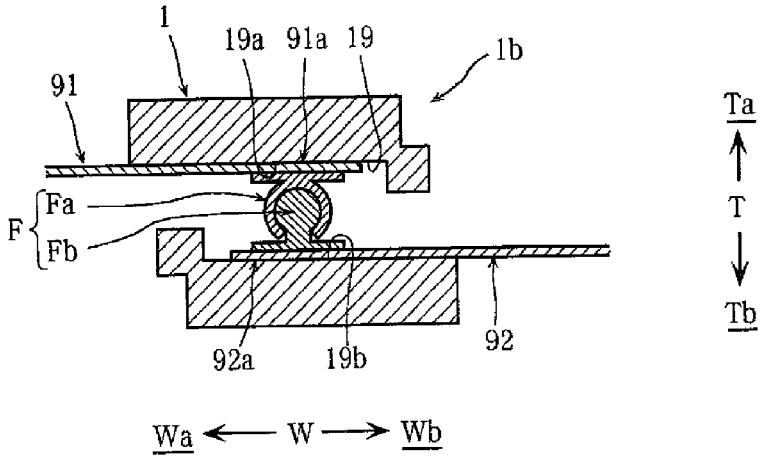
FIG. 9 A schematic cross-sectional view along Y-Y line of FIG. 7.

And, as shown in FIG. 6 and FIG. 9, in the half assembled state, the first and second side wall portions 26 and 27 of the second member 2 are not disposed on the both sides of the gathering portion 19 of the first member 1, the gathering portion 19 can be enlarged and deformed, and the closed fastener F (in a state that the fastener male-female portion Fa and the other fastener male-female portion Fb are hitched) can be easily inserted.

A sliding means 5 to relatively move the first member 1 and the second member 2 in the back-and-forth direction N for mutual approach and departure, as shown in FIG. 4, FIG. 5, FIG. 10, and FIG. 11, is provided with a first convex ridge portion 51 protruding from the side wall portion 16 of the first member 1 toward the side Wa along the back-and-forth direction N, a second convex ridge portion 52 protruding from the other side wall portion 17 of the first member 1 toward the other side Wb along the back-and-forth direction N, a first guiding concave portion 53, concaved on the inner face of the first side wall portion 26 of the second member 2 toward the side Wa along the back-and-forth direction N, to which the first convex ridge portion 51 is inserted as to freely slide back and forth, and a second guiding concave portion 54, concaved on the inner face of the second side wall portion 27 of the second member 2 toward the other side Wb along the back-and-forth direction N, to which the second convex ridge portion 52 is inserted as to freely slide back and forth.

Further, as shown in FIG. 2 and FIG. 14, a connecting means 6, which connects the first member 1 and the second member 2 to keep the approach completed state and make an assembly completed state on the approach completed position on which the first member 1 and the second member 2 are relatively moved and made mutually proximate, is provided.

The connecting means 6, as shown in FIG. 2 and FIGS. 10 through 14, is provided with plural hitching claw portions 61 protruding from left and right sides of the first member 1 outward and plural hitching window portions 62 formed through the second member 2 and hitched to the hitching claw portions 61 on the approach completed state.

Concretely, a pair of front hitching claw portions 61*a* protruding from left and right sides of the first member 1 outward, a pair of hitching window portions 62*a* formed through the second member 2 and hitched to the front hitching claw portions 61*a* on the approach completed state, a pair of rear hitching claw portions 61*b* protruding from left and right sides of the first member 1 outward, and a pair of hitching window portions 62*b* formed through the second member 2 and hitched to the rear hitching claw portions 61*b* on the approach completed state, are provided.

The hitching claw portions 61 on the side Wa are protruding from the first convex ridge portion 51, and the hitching claw portions 61 on the other side Wb are protruding from the second convex ridge portion 52. And, the hitching window portions 62 on the side Wa are formed through the first guiding concave portion 53, and the hitching window portions 62 on the other side Wb are formed through the second guiding concave portion 54.

And, as shown in FIG. 6, the front hitching claw portions 61*a* hitch to the rear hitching window portions 62*b* to prevent mutual departure (dividing) in the back-and-forth direction N over the predetermined back-and-forth dimension Z on a half assembled position on which the first member 1 and the second member 2 are relatively departed in the back-and-forth direction N for the predetermined back-and-forth dimension Z to dispose the second member 2 on the front side Na to the first member 1.

That is to say, a stopping means 7, provided with the hitching claw portions 61 and the hitching window portions 62 to position the first member 1 and the second member 2 to the approach completed position and make the half assembled state, is provided.

Figure 10:
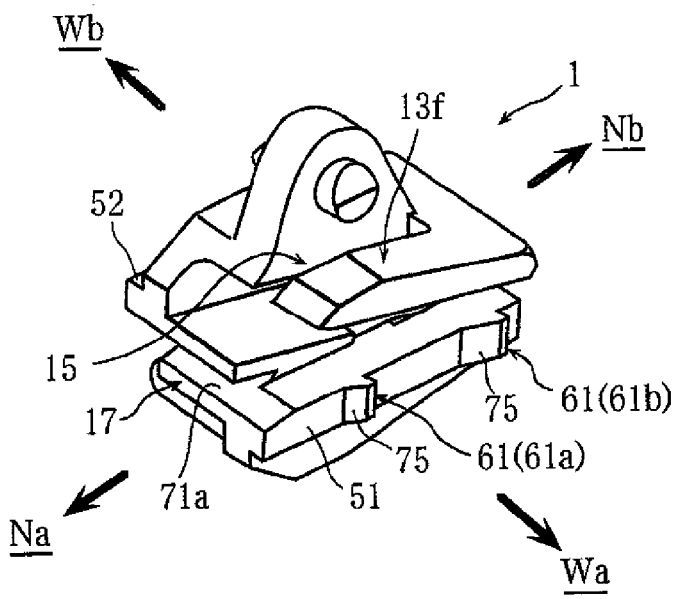
FIG. 10 A perspective view observed from upper front side showing an example of a first member.
Figure 11:
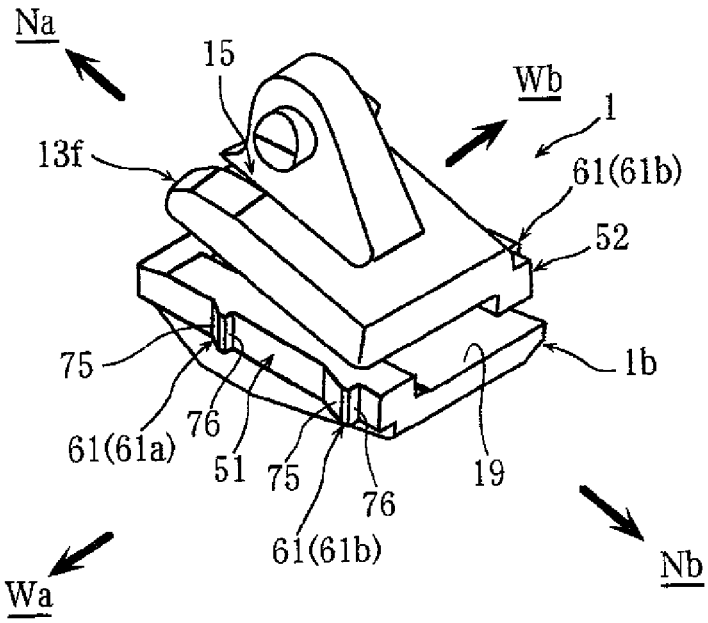
FIG. 11 A perspective view observed from upper rear side showing the example of the first member.
Figure 12:
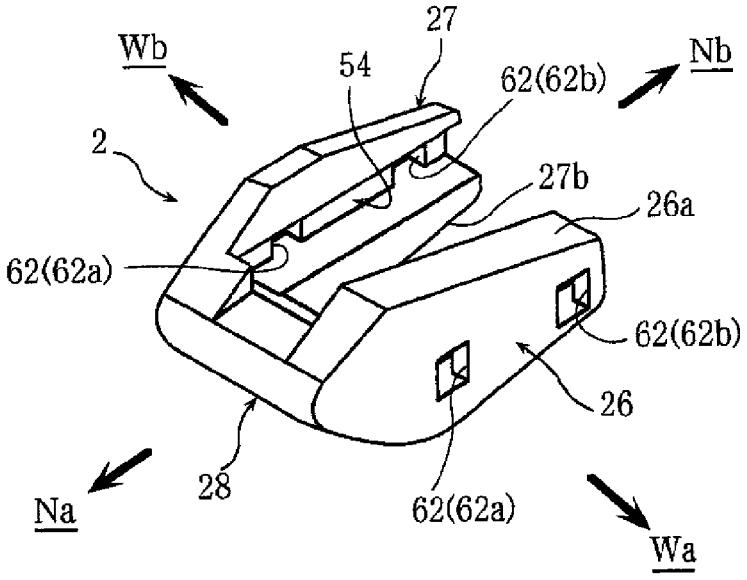
FIG. 12 A perspective view observed from upper front side showing an example of a second member.
Figure 13:
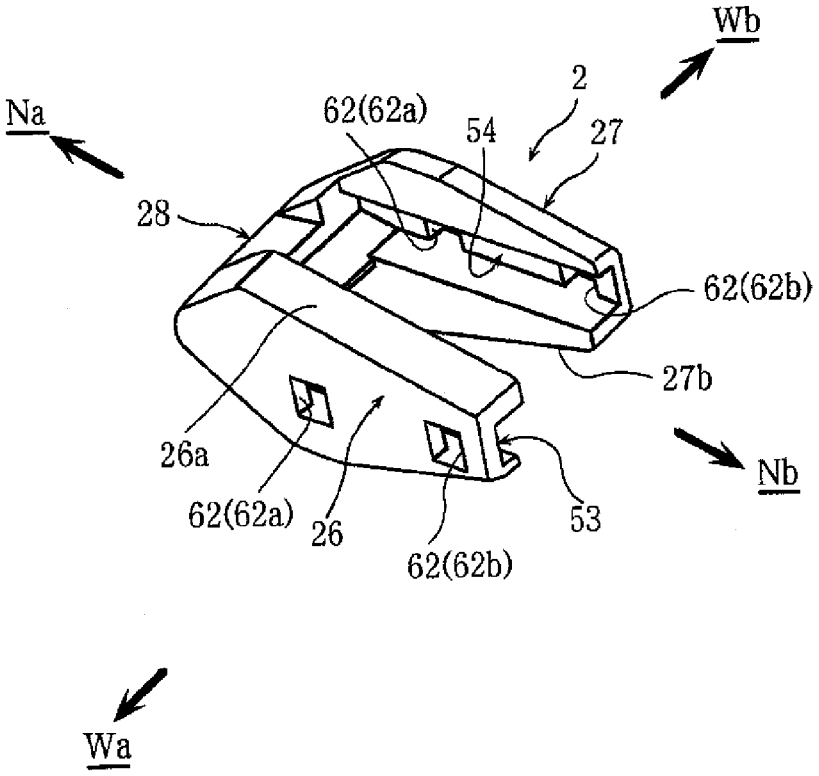
FIG. 13 A perspective view observed from upper rear side showing the example of the second member.

And, as shown in FIG. 10 and FIG. 11, the hitching claw portion 61 is formed into a burr type approximately triangular in top view having a guiding sloped face 75 inclined outward from the front side Na to the rear side Nb, and a hitching face 76 protruding outward from the first or second convex ridge portion 51 or 52 and connected to the rear edge side of the guiding sloped face 75.

When the first member 1 and the second member 2 mutually approach in the back-and-forth direction N, left and right inner faces of the first and second guiding concave portions 53 and 54 slide on the guiding sloped face and press the hitching claw portion 61 for elastic deformation. Or, the first and second side wall portions 26 and 27 of the second member 2 are elastically deformed by reaction force of the pressing as to be enlarged outward. And, when the rear end edge portion of the hitching window portion 62 passes the guiding sloped face 75, the rear inner face of the hitching window portion 62 hitches to the hitching face 76 of the hitching claw portion 61, and the mutual departure of the first member 1 and the second member 2 in the back-and-forth direction N is prevented to make the assembly completed state in which the connection is completed.

And, in the assembly completed state in FIG. 3, the connecting portion 28 of the second member 2 contacts the front wall portion 71 of the first member 1. For example, when observed with the first member 1 in fixation, the second member 2 is prevented from going excessively backward.

And, a concave portion 71*a* opening to the front side Na is disposed on the front wall portion 71 of the first member 1, and a convex portion 28*a* protruding to the rear side Nb and inserted to the concave portion 71*a* in the assembly completed state is disposed on the connecting portion 28 of the second member 2 as to prevent mutual positional deviation and looseness of the first member 1 and the second member 2 in the assembly completed state.

And, as shown in FIG. 5, the second member 2, on the approach completed position (in the assembly completed state), prevents swinging of the lower wall portion 14 corresponding to the gathering portion 19 of the first member 1 to a lower side Tb with rigidity of the first side wall portion 26, and prevents swinging of the upper wall portion 13 corresponding to the gathering portion 19 of the first member 1 to an upper side Ta with rigidity of the second side wall portion 27 as to prevent the gathering portion 19 of the first member 1 from being enlarged and deformed in the up-and-down direction T.

Figure 15:
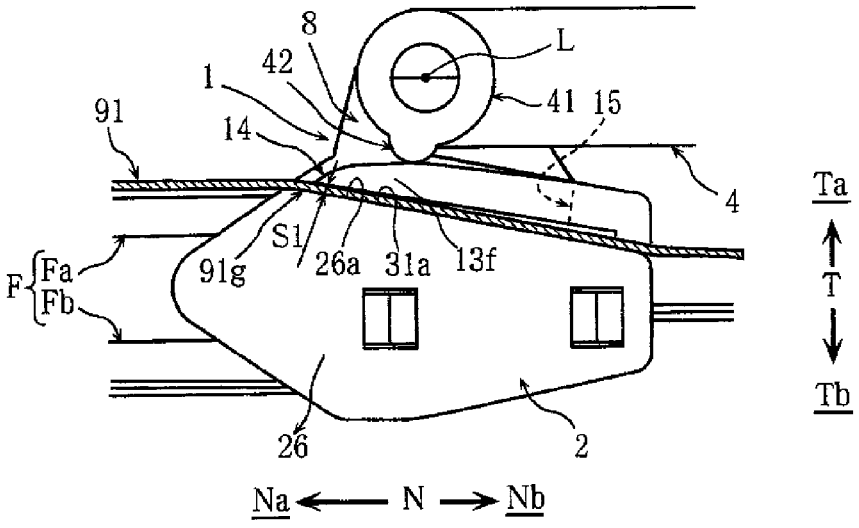
FIG. 15 A side view of one side of slide locking state.
Figure 16:
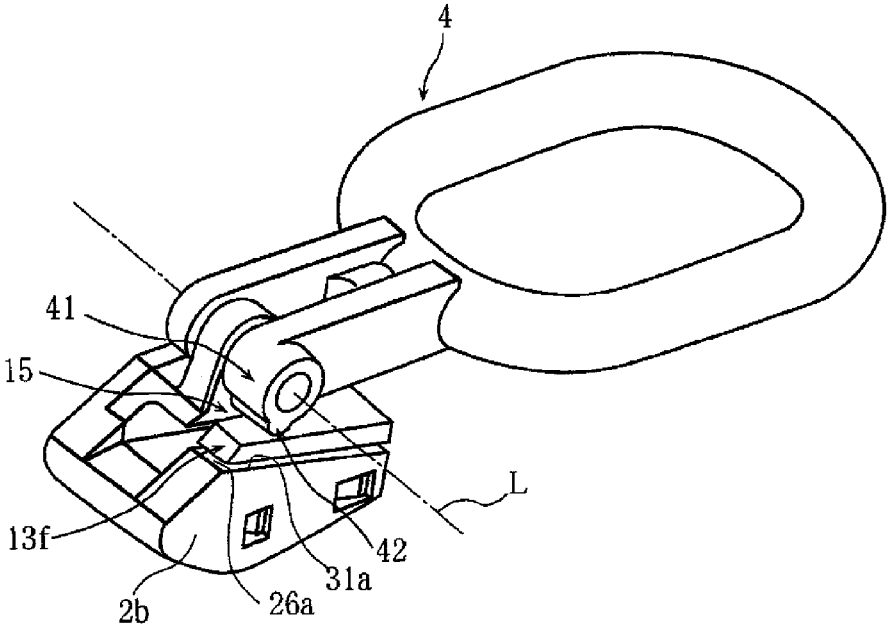
FIG. 16 A perspective view of the slide locking state observed from upper front side.

Further, as shown in FIG. 15 and FIG. 16, a slide locking (open-close operation locking) means 8, to partially reduce the first opening width dimension S1 further on the approach completed position (in the assembly completed state) to hold the first sheet portion 91 to prevent sliding in the back-and-forth direction N for open-close operation of the fastener F, is provided.

The slide locking means 8 is provided with a pressing convex portion 42 protruding from a pivoted base end portion 41 on the side Wa of the grip member 4 of resin pivoted to the upper wall portion of the first member 1 as to freely oscillate around a pivot axis L in the left-and-right direction W, and an elastic piece portion 13*f* composed of a portion made oscillatable up and down by the notched portion 15 (refer to FIGS. 8, 10, and 11) where the upper wall portion 13 of the first member 1 is notched from the front side Na near the pivoted base end portion 41.

The elastic piece portion 13*f* is a part of one side edge portion of the upper wall portion 13 of the first member 1 facing the upper face 26*a* of the first side wall portion 26 of the second member 2.

The slide locking means 8 is constructed as that the pressing convex portion 42 is moved around the pivot axis L by turning an oscillation end portion of the grip member 4, the elastic piece portion 13*f* is pressed downward and made close to the upper face 26*a* of the first side wall portion 26, the first opening width dimension S1 is forcedly reduced further, and the film portion 91*g* of the first sheet portion 91 in the opening portion 31*a* is held and pressed.

And, in FIG. 3, the gathering portion 19 of the first member 1 has a first convex portion 19*a* for gathering protruding from the lower face 13*b* of the upper wall portion 13 to the lower side Tb, and a second convex portion 19*b* for gathering protruding from the upper face 14*a* of the lower wall portion 14 to the upper side Ta. The fastener male-female portion Fa and the other fastener male-female portion Fb are certainly hitched by the first and second convex portions 19*a* and 19*b* for gathering. The first and second convex portions 19*a* and 19*b* for gathering are not shown in FIG. 10, FIG. 11, and FIG. 16.

Next, a method of use (function) of the embodiment of the slider structure of the present invention is described.

The first member 1 and the second member 2 are made closer in the back-and-forth direction N to make the half assembled state as shown in FIG. 6 in which the front hitching claw portions 61*a* of the first member 1 and the rear hitching window portions 62*b* are hitched, the first member 1 is disposed on the rear side Nb to the second member 2 with mutual departure in the back-and-forth direction N for the predetermined back-and-forth dimension Z.

The first member 1 and the second member 2 in the half assembled state are disposed on the opening portion 9*d* in opening state, the fastener male-female portion Fa (the opening end edge portion 91*a* of the first sheet portion 91) is made close to the first insertion groove 31 from the side Wa, or the first insertion groove 31 is made close to the fastener male-female portion Fa from the other side Wb, and inserted through the opening portion 31*a*, and, the other fastener male-female portion Fb (the opening end edge portion 92*a* of the second sheet portion 92) is made close to the second insertion groove 32 from the other side Wb, or the second insertion groove 32 is made close to the other fastener male-female portion Fb from the side Wa, and inserted through the other opening portion 32*a*. The opening width dimensions S1 and S2 are sufficiently wide, and the fastener can be easily attached to the bag body 9 (the opening portion 9*d*).

The first member 1 and the second member 2 in the half assembled state, attached to the fastener male-female portion Fa and the other fastener male-female portion Fb, are slid to the rear side Nb along the fastener F, and the fastener F in closed state, in which the fastener male-female portion Fa and the other fastener male-female portion Fb are preliminarily hitched, is inserted to the gathering portion 19 of the first member 1 from the rear side Nb. Or, the gathering portion 19 of the first member 1 is inserted to the fastener F in closed state with enlarged elastic deformation before the fastener male-female portion Fa and the other fastener male-female portion Fb are attached to the insertion grooves 31 and 32 respectively. The gathering portion 19 of the first member 1 is easily inserted in the half assembled state because of the enlarged elastic deformation in the up-and-down direction T.

The first member 1 and the second member 2 in the half assembled state are not departed for the stopping means 7 (hitching of the front hitching claw portions 61*a* of the first member 1 and the rear hitching window portions 62*b* of the second member 2), dropping in the attachment work to the bag body 9 and missing of members are prevented.

And, as shown in FIGS. 6 through 9, the first member 1 and the second member 2 in the half assembled state attached to the first sheet portion 91 and the second sheet portion 92 are relatively moved in the back-and-forth direction N to mutually come close, the first opening width dimension S1 is reduced as the side edge portion of the lower face 13*b* of the upper wall portion 13 of the first member 1 approaches the front part of the upper face 26*a* of the first side wall portion 26 of the second member 2, and the second opening width dimension S2 is reduced as the other side edge portion of the upper face 14*a* of the lower wall portion 14 of the first member 1 approaches the front part of the lower face 27*b* of the second side wall portion 27 of the second member 2.

Further, in the approach completed state of mutual proximity, as shown in FIG. 2, the front hitching claw portion 61*a* of the first member 1 of the connecting means 6 hitches to the front hitching window portion 62*a*, the rear hitching claw portion 61*b* of the first member 1 hitches to the rear hitching window portion 62*b* of the second member 2, and the assembly completed state, in which the first member 1 and the second member 2 are unitedly connected, is made.

In the assembly completed state, the first opening width dimension S1 is reduced to a size that the film portion 91*g* of the first sheet portion 91 can be inserted in the left-and-right direction W and the fastener male-female portion Fa can't be inserted in the left-and-right direction W, and the second opening width dimension S2 is reduced to a size that the film portion 92*g* of the second sheet portion 92 can be inserted in the left-and-right direction W and the other fastener male-female portion Fb can't be inserted in the left-and-right direction W.

Dropping in the left-and-right direction W of the fastener male-female portion Fa and the other fastener male-female portion Fb in the inserted grooves 31 and 32 is prevented.

And, in case that the sliding movement of the first member 1 and the second member 2 in the assembly completed state to keep the opened state or the closed state of the fastener F, as shown in FIG. 2, the grip member 4 in standing posture is oscillated around the pivot axis L to a horizontal posture by lay down the oscillation end portion to the rear side Nb, the pressing convex portion 42 presses the elastic piece portion 13*f* to the lower side Tb, the first opening width dimension S1 on the front part of the opening portion 31*a* becomes smaller than the thickness dimension of the film portion 91*g* of the first sheet portion 91, and the film portion 91*g* of the first sheet portion 91 (hear the opening end edge portion 91*a*) is held and pressed to make the slide locking state as shown in FIG. 15 in which the sliding movement in the back-and-forth direction N is stopped.

And, in the slide locking state in FIG. 15, the oscillation end portion of the grip member 4 is oscillated upward around the pivot axis L to the standing posture, the pressing convex portion 42 is departed from the elastic piece portion 13*f*, the first opening width dimension S1 is returned by elastic resilient force of the elastic piece portion 13*f*, the film portion 91*g* is not held and pressed, and the slide locking is released.

And, it is possible to release the hitching by pushing the hitching claw portion 61 by fingers or tools through the hitching window portion 62, or, making the first and second side wall portions 26 and 27 departed outward by reaction force, and, the first member 1 and the second member 2 are made sliding in the back-and-forth direction N as to be mutually departed, and the half assembled state of the first member 1 and the second member 2 is made to be departed from the bag body 9.

In the present invention, being modifiable, although the pressing convex portion 42 is arranged to make the slide locking when the oscillation end portion of the grip member 4 is turned down to the rear side Nb in figures, the pressing convex portion 42 may be arranged to make the slide locking when the oscillation end portion of the grip member 4 is turned down to the front side Na. And, the pressing convex portion 42 may be disposed on two positions.

And, the directions are explained with the state in which the bag body 9 is placed along the horizontal placement face G as the standard posture to make the explanation of the present invention easy. Therefore, the postures of used state are not restricted by the directions.

The bag body 9 to which the slider structure relating to the present invention is applied is preferably a bag in which a fastener male member and a fastener female member of resin (plastic) are unitedly formed with a film of synthetic resin by fusion such as heat fusion and supersonic fusion. And, although the concave fastener female portion of which cross section is C-shaped is disposed on the first sheet portion 91 and the convex fastener male portion of which cross section is a round head is disposed on the second sheet portion 92 in figures, the fastener male portion may be disposed on the first sheet portion 91 and the fastener female portion may be disposed on the second sheet portion 92. And, not restricted to configurations in top view shown in figures, the bag may have a handle, and may have configurations in top view other than rectangular.

As described above, the slider structure of the present invention can be applied to the fastener F disposed on the opening portion 9*d* to open the sheet middle body on the upper side of the bag body 9 in the up-and-down direction T because the slider structure of the present invention is provided with the first member 1 having the gathering portion 19, to press the fastener male-female portion Fa disposed on the first sheet portion 91 and the other fastener male-female portion Fb disposed on the second sheet portion 92 mutually in up-and-down direction T to be hitched, on the rear end portion 1*b*, and the second member 2 attached to the first member 1 as to move for the predetermined back-and-forth dimension Z in the back-and-forth direction N; and, the first insertion groove 31 inclined forward and upward to which the fastener male-female portion Fa is inserted and opening to the side Wa, and the second insertion groove 32 inclined forward and downward to which the other fastener male-female portion Fb is inserted and opening to another side Wb, are formed by the first member 1 and the second member 2; and the opening width dimension S1 of the first insertion groove 31 and the opening width dimension S2 of the second insertion groove are reduced when the first member 1 and the second member 2 are relatively moved in the back-and-forth direction N and mutually come close to conduct stopping in left-and-right direction W of the fastener male-female portion Fa in the first insertion groove 31 and the other fastener male-female portion Fb in the second insertion groove 32. The open-close operation of the bag body 9 can be easily and smoothly conducted with stability. The attachment to the opening portion 9*d* of the bag body 9 can be conducted easily and swiftly. The slider structure can be detachably attached to the bag body 9 for storing to which the opening portion 9*d* and the fastener F are provided. That is to say, even if the forth end and rear end are impossible to open and close for fusion or adhesion, the slider structure can be attached later to the middle portion of the fastener F with approach in the left-and-right direction W.

And, the first member 1 and the second member 2 are prevented from being departed in the open-close operation of the fastener, and stable open-close operation can be realized for a long period because the connecting means 6, to connect the first member 1 and the second member 2 on an approach completed position on which the first member 1 and the second member 2 are relatively moved in the back-and-forth direction N and made mutually proximate, is provided. The first member 1 and the second member 2 are prevented from being lost.

And, the gathering portion 19, yielding to reaction force pressing the fastener male-female portion Fa and the other fastener male-female portion Fb, is prevented from being enlarged and deformed and making the hitching imperfect when the fastener F is slid to close because the second member 2 prevents the gathering portion 19 of the first member 1 from being enlarged and deformed in the up-and-down direction T on the approach completed position on which the first member 1 and the second member 2 are relatively moved in the back-and-forth direction N and made mutually proximate. The fastener F can be stably and certainly closed. And, the gathering portion 19 can be enlarged and deformed before the approach is completed, and the fastener F in closed state can be easily and smoothly inserted when attached to the bag body 9.

And, unintentional opening and closing of the fastener F can be prevented because the slide locking means 8, to partially and forcedly reduce the opening width dimension S1 of the first insertion groove 31 to press the first sheet portion 91 for stopping movement in the back-and-forth direction N on the approach completed position on which the first member 1 and the second member 2 are relatively moved in the back-and-forth direction N and made mutually proximate. Especially, when the bag body 9 is carried, unintentional opening of the fastener F on the opening portion 9*d* of the bag body 9 caused by self weight of the members 1, 2, and 4 or vibration, can be prevented.

EXPLANATION OF THE MARKS

1 A first member
1*b* A rear end portion
2 A second member
6 A connecting means
8 A slide locking means
19 A gathering portion
31 A first insertion groove
32 A second insertion groove
91 A first sheet portion
92 A second sheet portion
Fa A fastener male-female portion
Fb Another fastener male-female portion
N A back-and-forth direction
S1 An opening width dimension
S2 An opening width dimension
T An up-and-down direction
W A left-and-right direction
Wa A side
Wb Another side
Z A predetermined back-and-forth dimension

The invention claimed is:

1. A slider structure provided with a first member (1) having a gathering portion (19), to press a fastener male-female portion (Fa) disposed on a first sheet portion (91) and another fastener male-female portion (Fb) disposed on a second sheet portion (92) mutually in up-and-down direction (T) to be hitched, on a rear end portion (1*b*), and a second member (2) attached to the first member (1) as to move for a predetermined back-and-forth dimension (Z) in back-and-forth direction (N); characterized by a construction in which:

a first insertion groove (31) inclined forward and upward to which the fastener male-female portion (Fa) is inserted and opening to a side (Wa), and a second insertion groove (32) inclined forward and downward to which the other fastener male-female portion (Fb) is inserted and opening to another side (Wb), are formed by the first member (1) and the second member (2); and an opening width dimension (S1) of the first insertion groove (31) and an opening width dimension (S2) of the second insertion groove (32) are reduced when the first member (1) and the second member (2) are relatively moved in the back-and-forth direction (N) and mutually come close to conduct stopping in left-and-right direction (W) of the fastener male-female portion (Fa) in the first insertion groove (31) and the other fastener male-female portion (Fb) in the second insertion groove (32).

2. The slider structure as set forth in claim 1, wherein a connecting means (6), to connect the first member (1) and the second member (2) on an approach completed position on which the first member (1) and the second member (2) are relatively moved in the back-and-forth direction (N) and made mutually proximate, is provided.

3. The slider structure as set forth in claim 1, wherein the second member (2) prevents the gathering portion (19) of the first member (1) from being enlarged and deformed in the up-and-down direction (T) on an approach completed position on which the first member (1) and the second member (2) are relatively moved in the back-and-forth direction (N) and made mutually proximate.

4. The slider structure as set forth in claim 1, wherein a slide locking means (8), to partially and forcedly reduce the opening width dimension (S1) of the first insertion groove (31) to press the first sheet portion (91) for stopping movement in the back-and-forth direction (N) on an approach completed position on which the first member (1) and the second member (2) are relatively moved in the back-and-forth direction (N) and made mutually proximate.

5. The slider structure as set forth in claim 2, wherein the second member (2) prevents the gathering portion (19) of the first member (1) from being enlarged and deformed in the up-and-down direction (T) on an approach completed position on which the first member (1) and the second member (2) are relatively moved in the back-and-forth direction (N) and made mutually proximate.

* * * * *